US006000545A

United States Patent [19]

Smith

[11] Patent Number: 6,000,545

[45] Date of Patent: Dec. 14, 1999

[54] FOLDABLE PACKAGING DEVICE FOR PROTECTING ARTICLES WITHIN A BOX AND THE LIKE

[76] Inventor: Steven H. Smith, 2190 Keota Ln., Superior, Colo. 80027

[21] Appl. No.: 09/165,540

[22] Filed: Oct. 2, 1998

[51] Int. Cl.[6] ..... B65D 81/02

[52] U.S. Cl. ..... 206/523; 206/320; 206/586; 206/591; 53/472

[58] Field of Search ..... 206/521, 523, 206/586, 591–594, 453, 460, 813, 320, 223, 576, 577; 53/467, 472

[56] References Cited

U.S. PATENT DOCUMENTS

| | | | |
|---|---|---|---|
| 2,733,851 | 2/1956 | Van Ness | 206/592 |
| 2,979,246 | 4/1961 | Liebeskind . | |
| 3,161,339 | 12/1964 | Weller | 206/586 |
| 3,166,227 | 1/1965 | Ragnow . | |
| 3,361,322 | 1/1968 | Gabriel et al. . | |
| 3,511,464 | 5/1970 | Doll . | |
| 3,542,282 | 11/1970 | Troth . | |
| 3,565,243 | 2/1971 | Freeman . | |
| 3,973,720 | 8/1976 | Schmid . | |
| 4,287,265 | 9/1981 | McKnight | 206/586 |
| 4,339,039 | 7/1982 | Mykleby | 206/591 |
| 4,529,091 | 7/1985 | Martin | 206/586 |
| 4,851,286 | 7/1989 | Maurice . | |
| 4,927,023 | 5/1990 | Elzey . | |

FOREIGN PATENT DOCUMENTS

| | | |
|---|---|---|
| 4-267769 | of 1991 | Japan . |
| 2 081 678 | 2/1982 | United Kingdom . |
| 2 246 767 | 2/1992 | United Kingdom . |

*Primary Examiner*—Paul T. Sewell
*Assistant Examiner*—Luan K. Bui
*Attorney, Agent, or Firm*—Emery L. Tracy

[57] ABSTRACT

A cushioning device for protecting corners and edges of an article when packaged in a box is provided. The device comprises a panel member having a plurality of panel portions with each of the panel portions hingedly connected to at least one adjacent panel portion. Cushioning is secured to at least one of the panel portions for cushioning the article wherein the panel portions fold into a three-dimensional receptacle forming an open corner cushioning device for protecting the corners and sides of an article. A securing mechanism on the panel member secures for securing the panel member within the box wherein the article is securable within the box.

18 Claims, 7 Drawing Sheets

FOLDABLE PACKAGING DEVICE FOR PROTECTING ARTICLES WITHIN A BOX AND THE LIKE

BACKGROUND OF THE INVENTION

1. Field of the Invention

This invention relates generally to a foldable packaging device for protecting articles within a box and the like and, more particularly, it relates to a foldable packaging device for protecting the corners and edges of packed articles within a box and the like.

2. Description of the Prior Art

When articles are shipped from one location to another, it is necessary to safely pack or crate the articles to inhibit damage to the articles. In many cases, such articles consist of electronic instruments, cabinets, desks, appliances, furniture, and a wide variety of other similar articles which have substantially rectangular or square-shaped edges. In the past, articles such as those listed above, have been packaged in various different ways, but in most cases, such packaging devices and techniques have been unsatisfactory to inhibit damage.

One technique used by many companies and people to package various articles has been to utilize packing material formed from shredded or wadded paper. Prior to the article being place in the box or crate, the packing material is placed at the bottom of the box or crate. Once the article is placed in the carton or crate, the packing material is stuffed into the packing carton or crate about the sides, back, and top of the article. The box or crate is then closed and sealed. Clearly, to accomplish this packing technique, an excessive amount of packing material is required which is expensive, and once the article has arrived at its final destination, the user must then remove and dispose of all of this packing material. Furthermore, the described technique provides questionable protection of the articles since the packing material would tend to move and shift during transport of the article thereby compromising the ability of the packing material to protect the article.

Another technique which has been utilized to package articles such as electronic instruments or the like, has been to use pre-formed cushions of a resilient material, such as expanded polystyrene or rubber. The packing cushions are pre-formed in that the cushions are molded to conform to the contour of either the top or bottom, or both, of the article to be packaged. This technique permits the article to be positioned, for example, in a bottom pre-formed cushion after which a top pre-formed cushion is positioned on top the article. The article is then enclosed and sealed within the box or crate thereby effectively sandwiching the article between the packing cushions within the box.

Unfortunately, even though such packing material originally accompanies the article from the manufacture to the consumer, the packing material is either disposed with the original box due to the bulkiness of the packing material or otherwise misplaced or lost such that when the article is being prepared to be transported again, the original packing material is no longer available. Therefore, unless the user can acquire additional pre-formed cushions at a relatively high cost, the user is forced to employ the first technique list above by wadding paper or other material into the box or crate. Furthermore, such pre-formed cushions are molded to fit a particular article, such that the pre-formed cushions cannot be used for any other articles which are of a different size thereby limiting the interchangeability in utilizing such pre-formed cushions with other articles.

There have been attempts in the prior art to improve the shortcomings in packaging materials. The Schmid, U.S. Pat. No. 3,973,720, describes a protective cushioning pad formed from a single piece of substantially flat, resilient material formed into at least two discrete sections with each section being foldable with respect to another section along a full fold line therebetween. A metallic strip is mounted on the material and traverses each of the fold lines between adjacent sections permitting each of the sections to be folded with respect to the next adjacent section and retained in any preselected angularized folded position. Alternatively, the metallic strip permits the sections to be unfolded with respect to one another and positioned in a flat or unfolded posture.

Unfortunately, the cushioning pad of the Schmid patent has several deficiencies. First, while the metallic strips permit the sections to maintain their folded position, the addition of the metallic strips to the cushioning pad increases the costs of manufacturing the cushioning device which, in turn, increases the costs to the purchasing consumers. Second, the Schmid patent's cushioning device does not provide any means for securing the cushioning pad to the box or crate after insertion of the cushioning device. Upon shipping, the cushioning pads, and the articles packed within the box, will tend to move about the box thereby increasing the chances of the articles being damaged. Furthermore, the cushioning pads of the Schmid patent are not positionable anywhere within the box such that they lock the article within the box in place.

Accordingly, there exists a need for a foldable packaging device for protecting articles within a box and the like. Additionally, a need exists for a foldable packing device which maintains its predetermined shape when positioned about the corners of the articles within the box and the like. Furthermore, there exists a need for a foldable packaging device which maintains its predetermined position relative to the box and locks the article into place upon positioning of the foldable packing device within the box and the like.

SUMMARY

The present invention is a cushioning device for protecting corners and edges of an article when packaged in a box. The device comprises a panel member having a plurality of panel portions with each of the panel portions hingedly connected to at least one adjacent panel portion. Cushioning means are secured to at least one of the panel portions for cushioning the article wherein the panel portions fold into a three-dimensional receptacle forming an open corner cushioning device for protecting the corners and sides of an article. Securing means on the panel member secures the panel member within the box wherein the article is securable within the box.

In an embodiment of the present invention, the panel portions include a first panel portion, a second panel portion, a third panel portion, and a fourth panel portion, with the first panel being foldably connected to the second panel portion and the fourth panel portion, the second panel portion being foldably connected to the third panel portion. A slit is formed between the third panel portion and the fourth panel portion. Preferably, the cushioning means comprises a first cushioning pad secured to a first panel portion, a second cushioning pad secured to a second panel portion, and a third cushioning pad secured to a third panel portion with the fourth panel portion being free from a cushioning pad. Furthermore, preferably, the receptacle has an interior article receiving area with the cushioning means covering substantially entirely the interior article receiving area.

In another embodiment of the present invention, the panel portions of the panel member are substantially equal sized.

In still another embodiment of the present invention, the panel member is constructed from corrugated cardboard. Preferably, the cushioning means comprises foam pads.

In yet another embodiment of the present invention, the securing means is an adhesive layer. Preferably, the cushioning device further comprises a liner cover releasably covering the adhesive layer with the liner cover removable to expose the adhesive layer.

In still yet another embodiment of the present invention, the cushioning device further comprises means for maintaining the panel member in a three-dimensional receptacle. Preferably, the means for maintaining includes an adhesive layer.

The present invention further includes a method for protecting corners and edges of an article when packaged in a box. The method comprises providing a panel member having a plurality of panel portions, hingedly connecting each of the panel portions to at least one adjacent panel portion, securing cushioning means to the panel member for cushioning the article, folding the panel portions into a three-dimensional receptacle thereby forming an open corner cushioning device for protecting the corners and sides of an article, and securing the cushioning device within the box.

In an embodiment of the present invention, the method further foldably connecting a first panel to a second panel portion and a fourth panel portion, foldably connecting the second panel portion to a third panel portion, and forming a slit between the third panel portion and the fourth panel portion. Preferably, the method further comprises securing a first cushioning pad to a first panel portion, securing a second cushioning pad to a second panel portion, and securing a third cushioning pad to a third panel portion. Furthermore, preferably, the method and further comprises covering substantially entirely an interior article receiving area of the receptacle.

In another embodiment of the present invention, the method further comprises the panel member is constructed from corrugated cardboard. Furthermore, preferably, the method wherein the cushioning means comprises foam pads.

In still another embodiment of the present invention, wherein the cushioning device is secured within the box with an adhesive layer. Preferably, the method further comprises releasably covering the adhesive layer with a liner cover, and further yet comprising removing the liner cover to expose the adhesive layer.

In yet another embodiment of the present invention, the method further comprises means for maintaining the panel member in a three-dimensional receptacle.

DETAILED DESCRIPTION OF THE PREFERRED EMBODIMENTS

Figure 1:
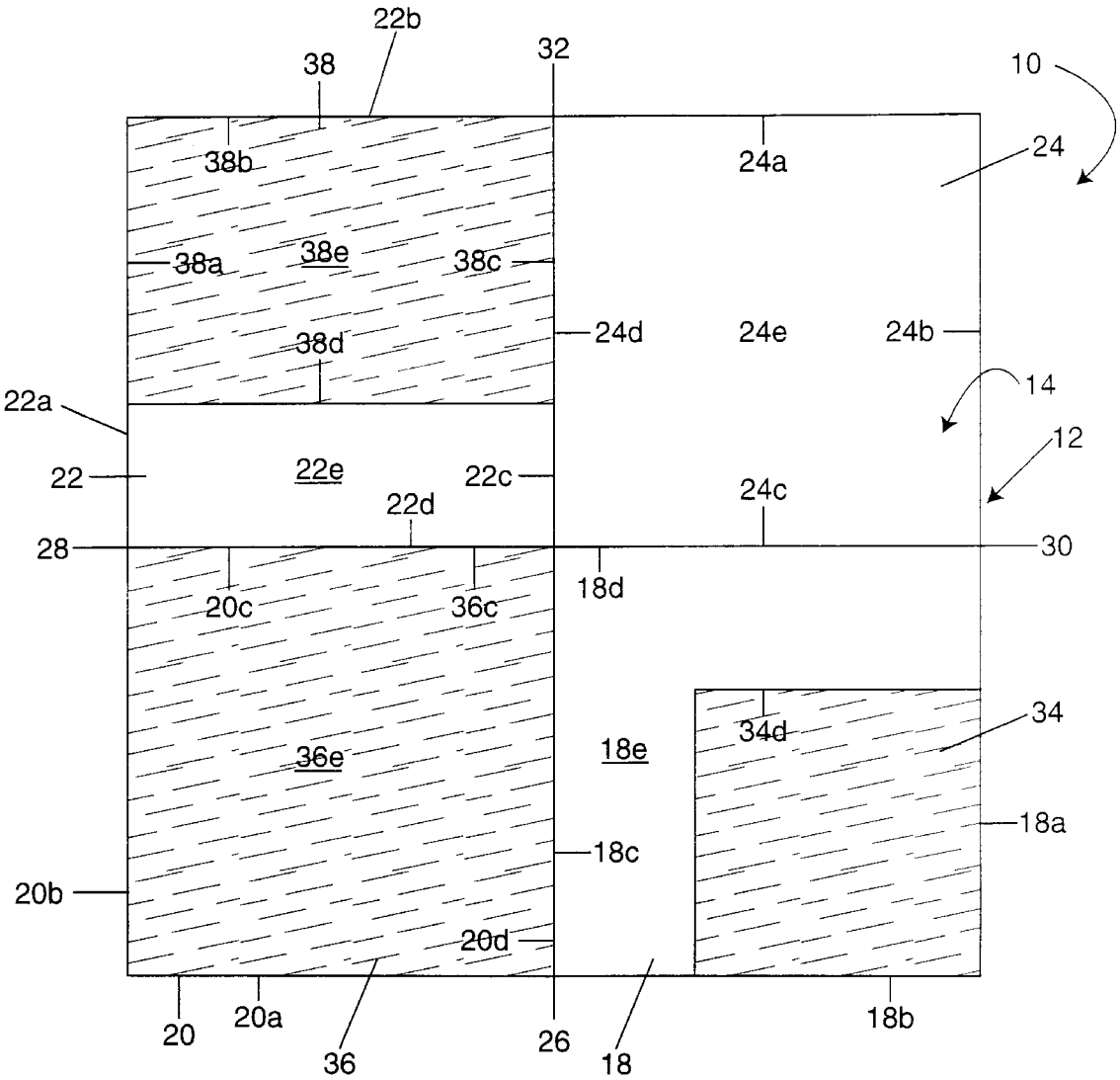
FIG. 1 is a top view illustrating a foldable packaging device constructed in accordance with the present invention prior to folding and insertion into a box.

As illustrated in FIG. 1, the present invention is a foldable packaging device, indicated generally at 10, for protecting articles within a box (not shown) and the like. The foldable packaging device 10 is a foldable, self-contained packaging device for protecting the corners and/or sides of the article when place in the box. Furthermore, the foldable packaging device 10 of the present invention can be positioned anywhere with the box, not just the corners of the box, "locking" the article within the box such that any variety of sized boxes can be used and is not dependent on the size of the article.

The foldable packaging device 10 has a substantially flat panel member 12 having a top surface 14 and a bottom surface 16. The flat panel member 12 is divided into four substantially equal quarter panels, namely a first quarter panel 18, a second quarter panel 20, a third quarter panel 22, and a fourth quarter panel 24. Each quarter panel 18, 20, 22, 24 has a predetermined width w' and a predetermined length 1'. Preferably, the width w' of each quarter panel 18, 20, 22, 24 is substantially equal to the length 1' of each quarter panel 18, 20, 22, 24.

In the packaging device 10, the quarter panels 18, 20, 22, 24 are hingedly connected to each adjacent quarter panel 18, 20, 22, 24 by a hinge member, namely a first hinge member 26 between the first quarter panel 18 and the second quarter panel 20, a second hinge member 28 between the second quarter panel 20 and the third quarter panel 22, a third hinge member 30 between the fourth quarter panel 24 and the first quarter panel 18. A slit 32 is formed in the panel member 12 between the third quarter panel 22 and the fourth quarter panel 24. It should be noted that the slit 32 between the third quarter panel 22 and the fourth quarter panel 24 can be a score line (not shown) which is broken during construction of the foldable packaging device 10, as will be described further below.

In any event, the first quarter panel 18 has a first outside edge 18*a*, a second outside edge 18*b* adjacent to and substantially perpendicular to the first outside edge 18*a*, a third inside edge 18*c* substantially parallel to the first outside edge 18*a* and adjacent to and substantially perpendicular to the second outside edge 18*b*, a fourth inside edge 18*d* adjacent and substantially perpendicular to the first outside edge 18*a* and the third inside edge 18*c*, a top surface 18*e*, and a bottom surface 18*d* substantially opposite the top surface 18*f*. The second quarter panel 20 has a first outside edge 20*a*, a second outside edge 20*b* adjacent to and substantially perpendicular to the first outside edge 20*a*, a third inside edge 20*c* substantially parallel to the first outside edge 20*a* and adjacent to and substantially perpendicular to the second outside edge 20*b*, a fourth inside edge 20*d* adjacent and substantially perpendicular to the first outside edge 20*a* and the third inside edge 20*c*, a top surface 20*e*, and a bottom surface 20*d* substantially opposite the top surface 20*f*. The third quarter panel 22 has a first outside edge 22*a*, a second outside edge 22*b* adjacent to and substantially perpendicular to the first outside edge 22*a*, a third inside edge 22*c* substantially parallel to the first outside edge 22*a* and adjacent to and substantially perpendicular to the second outside edge 22*b*, a fourth inside edge 22*d* adjacent and substantially perpendicular to the first outside edge 22*a* and the third inside edge 22*c*, a top surface 22*e*, and a bottom surface 22*d* substantially opposite the top surface 22*f*. The fourth quarter panel 24, has a first outside edge 24*a*, a second outside edge 24*b* adjacent to and substantially perpendicular to the first outside edge 24*a*, a third inside edge 24*c* substantially parallel to the first outside edge 24*a* and adjacent to and substantially perpendicular to the second outside edge 24*b*, a fourth inside edge 24*d* adjacent and substantially perpendicular to the first outside edge 24*a* and the third inside edge 24*c*, a top surface 24*e*, and a bottom surface 24*d* substantially opposite the top surface 24*f*.

The third inside edge 18*c* of the first quarter panel 18 is adjacent the fourth inside edge 20*d* of the second quarter panel 20 along the first hinge member 26. The third inside edge 20*c* of the second quarter panel 20 is adjacent the fourth inside edge 22*d* of the third quarter panel 22 along the second hinge member 28. The third inside edge 22*c* of the third quarter panel 22 is adjacent the fourth inside edge 24*d* of the fourth quarter panel 24 along the slit 32. The third inside edge 24*c* of the fourth quarter panel 24 is adjacent the fourth inside edge 18*d* of the first quarter panel 18 along the third hinge member 30. The actual construction and operation of the foldable packaging device 10 of the present invention will be described in further detail below.

Preferably, the panel member 12 is constructed from a substantially flat sheet of corrugated cardboard and the hinge members 26, 28, 30 are preferably fold lines formed in the cardboard. While the panel member 12 of the foldable packaging device 10 of the present invention has been described heretofore and will be described hereafter as being formed from cardboard, it is within the scope of the present invention to form the panel member 12 from any substantially rigid material including, but not limited to, multiple layer corrugated cardboard, plastic, wood, fiberglass, metal, etc. Furthermore, while the hinge members 26, 28, 30 have been described heretofore and will be described hereafter as being fold lines, it is within the scope of the present invention to have other types of hinge members 26, 28, 30 including, but not limited to, various mechanical-type hinges and the like.

Figure 2:
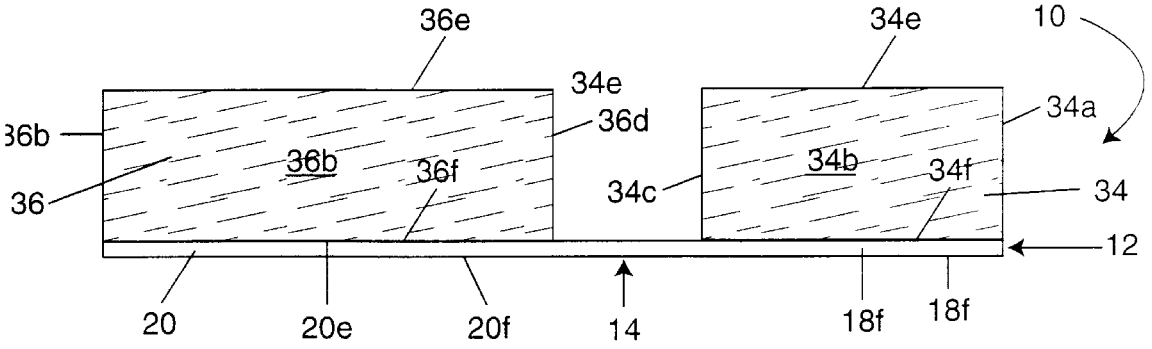
FIG. 2 is a side view illustrating a foldable packaging device constructed in accordance with the present invention prior to folding and insertion into a box.

As illustrated in FIGS. 1 and 2, the foldable packaging device 10 further has at least three cushion members, namely a first cushion member 34 having a top surface 34*e* and a bottom surface 34*f*, a second cushion member 36 having a top surface 36*e* and a bottom surface 36*f*, and a third cushion member 38 having a top surface 38*e* and a bottom surface 38*f*. As will be described in further detail below, the bottom surface 34*f*, 36*f*, 38*f* of each cushion member 34, 36, 38 is secured to the top surface 14 of the panel member 12.

The first cushion member 34 has a first side 34*a*, a second side 34*b* adjacent to and substantially perpendicular to the first side 34*a*, a third side 34*c* substantially parallel to the first side 34*a* and adjacent to and substantially perpendicular to the second side 34*b*, a fourth side 34*d* adjacent to and substantially perpendicular to the first side 34*a* and the third side 34*c*. The second cushion member 36 has a first side 36*a*, a second side 36*b* adjacent to and substantially perpendicular to the first side 36*a*, a third side 36*c* substantially parallel to the first side 36*a* and adjacent to and substantially perpendicular to the second side 36*b*, a fourth side 36*d* adjacent to and substantially perpendicular to the first side 36*a* and the third side 36*c*. The third cushion member 38 has a first side 38*a*, a second side 38*b* adjacent to and substantially perpendicular to the first side 38*a*, a third side 38*c* substantially parallel to the first side 38*a* and adjacent to and substantially perpendicular to the second side 38*b*, a fourth side 38*d* adjacent to and substantially perpendicular to the first side 38*a* and the third side 38*c*.

The bottom surface 34*f* of first cushion member 34 is secured to the top surface 18*e* of the first quarter panel 18 with the first side 34*a* aligned with the first outside edge 18*a* and the second side 34*b* aligned with the second outside edge 18*b* of the first quarter panel 18. The bottom surface 36*f* of the second cushion member 36 is secured to the top surface 20*e* of the second quarter panel member 20 with the first side 36*a* aligned with the first outside edge 20*a*, the second side 36*b* aligned with the second outside edge 20*b*, the third side 36*c* aligned with the third outside edge 20*c*, and the fourth side 36*d* aligned with the fourth inside edge 20*d* of the second quarter panel 20. The bottom surface 38*f* of the third cushion member 38 is secured to the top surface 22*e* of the third quarter panel 22 with the first side 38*a* aligned with the first outside edge 22*a* and the second side 38*b* aligned with the second outside edge 22*b* of the third quarter panel 22.

In a preferred embodiment of the packaging device 10 of the present invention, the first cushion member 34 has a predetermined thickness $t_1$, the second cushion member 36 has a predetermined thickness $t_2$, and the third cushion member 38 has a predetermined thickness $t_3$. Preferably, $t_1$ is approximately equal to $t_2$ and $t_2$ is approximately equal to $t_3$. In order to accommodate the folding, as will be described in further detail below, of the foldable packing device 10 of the present invention, the distance between the third side 34*c* of the first cushion member 34 and the fourth side 36*d* of the second cushion member 36 is substantially equal to the thickness $t_1$ of the first cushion member 34. Furthermore, the distance between the third side 36*c* of the second cushion member 36 and the fourth side 38*d* of the third cushion member 38 is substantially equal to the thickness $t_3$ of the third cushion member 38.

The cushion members 34, 36, 38 are preferably formed from a chip board or foam material which provides a cushioning effect for the articles. It is within the scope of the present invention, however, to form the cushion members 34, 36, 38 from other types of padding material.

Figure 3:
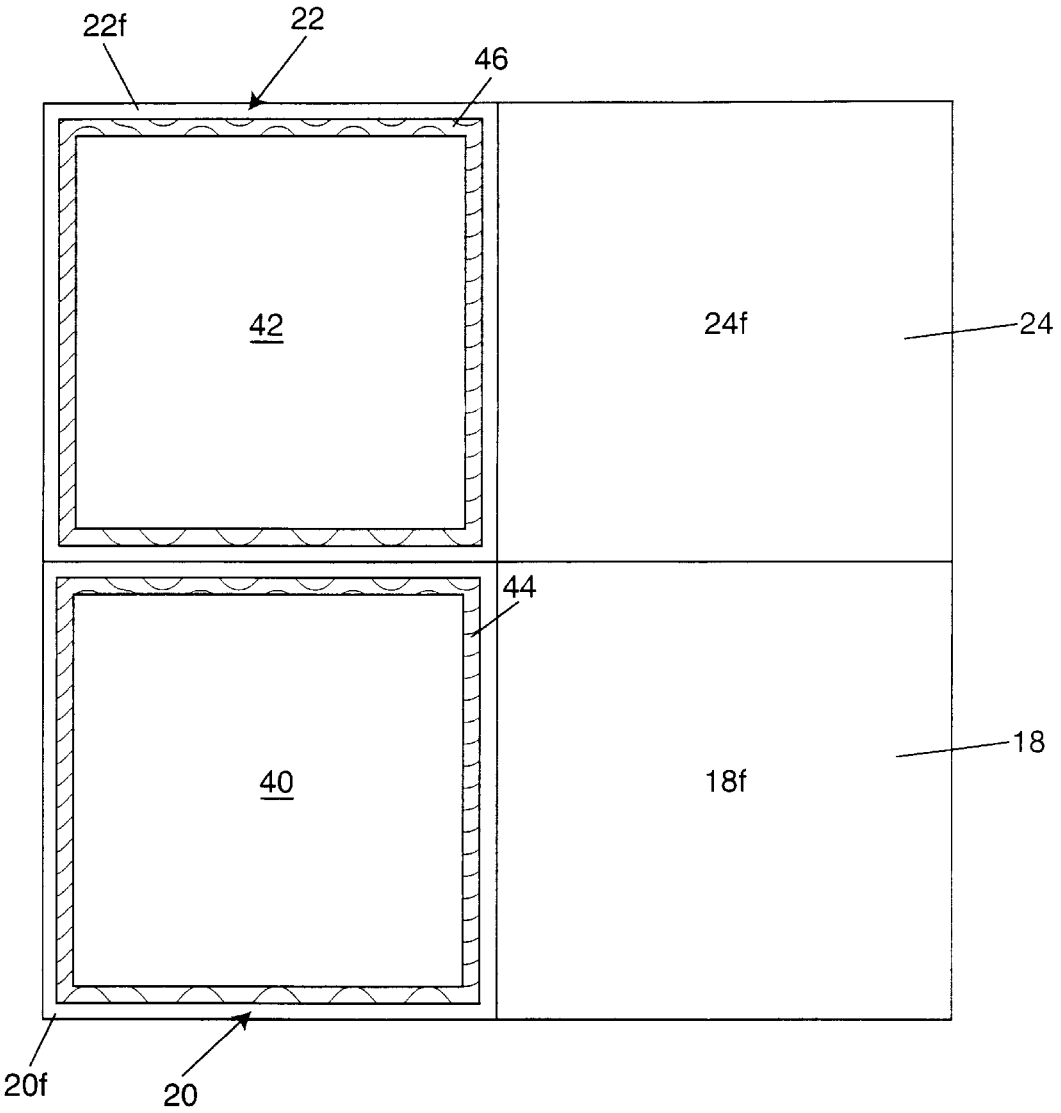
FIG. 3 is a bottom view illustrating a foldable packaging device constructed in accordance with the present invention prior to folding and insertion into a box.

As illustrated in FIG. 3, the foldable packaging device 10 further has a first adhesive layer 40 on the bottom surface 20*f* of the second quarter panel 20 and a second adhesive layer 42 on the bottom surface 22*f* of the third quarter panel 22. Preferably, both the first adhesive layer 40 and the second adhesive layer 42 is a hot melt-type adhesive although other types of adhesive layers are within the scope of the present invention. Furthermore, the first adhesive layer 40 is preferably releasably covered by a first liner cover 44 and the second adhesive layer 42 is preferably releasably covered by a second liner cover 46. The first liner cover 40 and the second liner cover 42 preserve the first adhesive layer 40 and the second adhesive layer 42, respectively, until the construction of the foldable packaging device 10, as will be described further below.

The construction and operation of the foldable packaging device 10 of the present invention will now be described in detail. Once again, it should be noted that while a particular construction and operation of the foldable packaging device 10 will be described below, it is within the scope of the present invention to construct and operate the foldable packaging device 10 in other manners.

Figure 4:
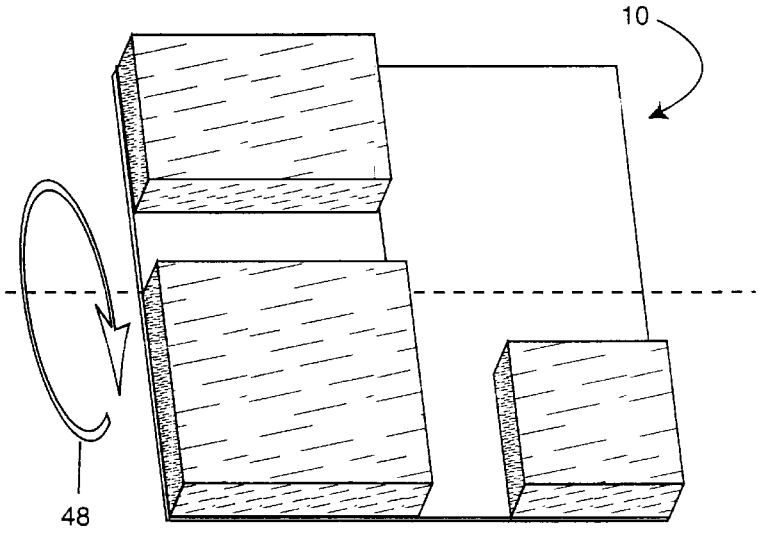
FIG. 4 is a perspective view illustrating a first folding step of the foldable packaging device constructed in accordance with the present invention and the substantially flat configuration of the packaging device prior to folding of the packaging device into its shipping configuration.
Figure 5:
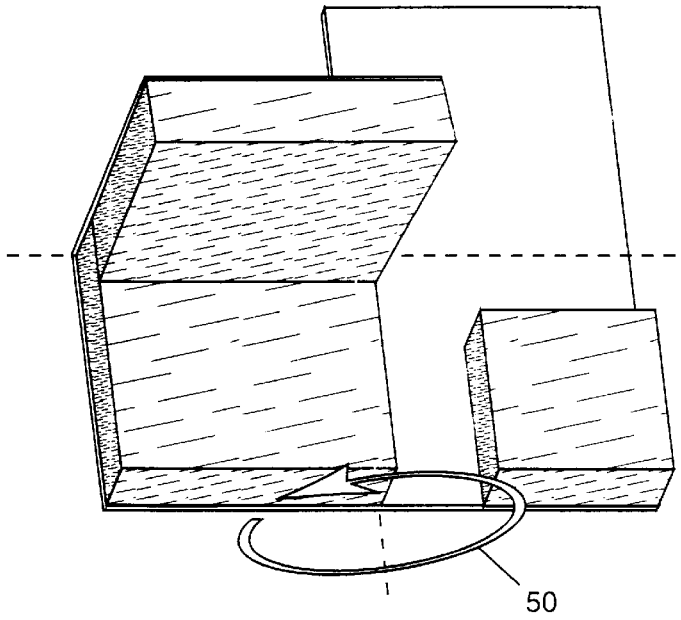
FIG. 5 is a perspective view illustrating a second folding step of the foldable packaging device constructed in accordance with the present invention during folding of the packaging device into its shipping configuration.
Figure 6:
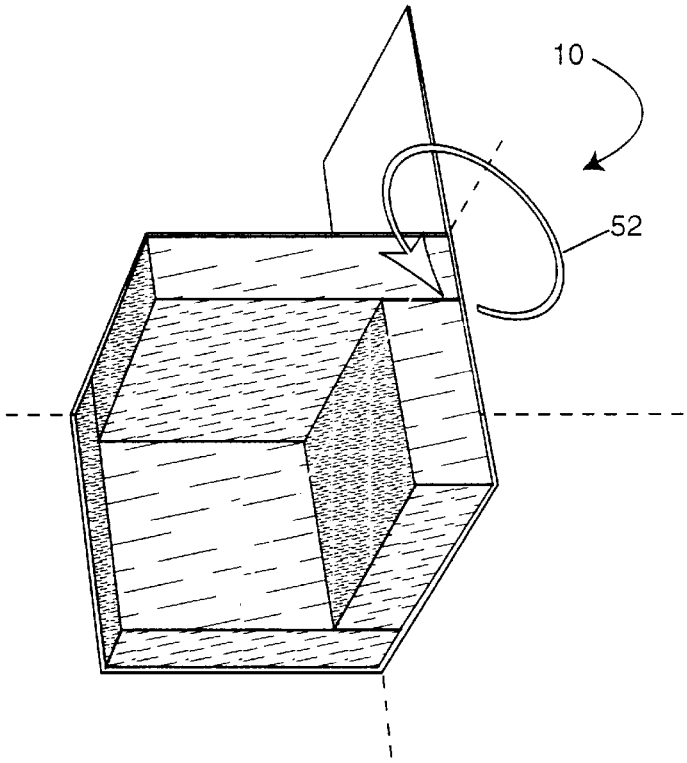
FIG. 6 is a perspective view illustrating a third folding step of the foldable packaging device constructed in accordance with the present invention during folding of the packaging device into its shipping configuration.

As illustrated in FIG. 4, to construct the foldable packaging device 10 of the present invention, first, the third quarter panel 22 is folded in a generally upward direction, indicated by a first arrow 48, along the second hinge member 28 until the third side 38*c* of the third cushion member 38 is positioned against the top surface 36*e* of the second cushion member 36 and the top surface 22*e* of the third quarter panel 22 is positioned against the third side 36*c* of the second cushion member 36. Second, as illustrated in FIG. 5, the first quarter panel 18 and the fourth quarter panel 24 are folded in a generally upward direction, indicated by a second arrow, along the first hinge member 26 until the third side 34*c* of the first cushion member 34 is positioned against the top surface 36*e* of the second cushion member 36, the third side 34*c* of the first cushion member 34 is positioned against the top surface 38*e* of the third cushion member 38, and the top surface 18*e* of the first quarter panel 18 is positioned against the fourth side 36*d* of the second cushion member 36. As illustrated in FIG. 6, third, the second liner cover 46 is removed exposing the second adhesive layer 42 on the bottom surface 22*f* of the third quarter panel 22 and the fourth quarter panel 24 is rotated, indicated by a third arrow 52, until the top surface 24*e* of the fourth quarter panel 24 contacts the second adhesive layer 42 of the third quarter panel 22 and is securely held thereto.

Figure 7:
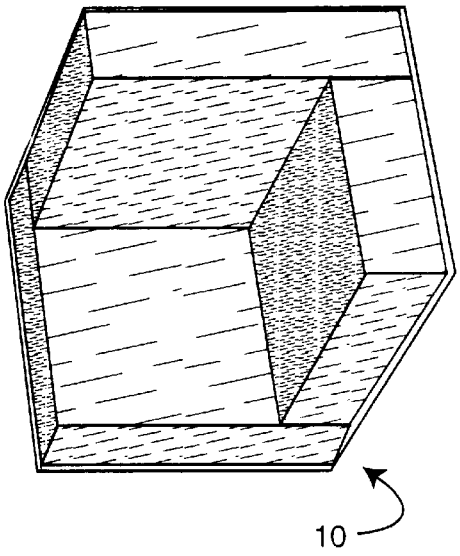
FIG. 7 is a perspective view illustrating the shipping configuration of the foldable packaging device constructed in accordance with the present invention.

As illustrated in FIG. 7, the open corner-shaped foldable packaging device 10 is ready for insertion into a box or the like. Prior to insertion into the box, the first liner cover 44 is removed exposing the first adhesive layer 40 on the bottom surface 20*f* of the second quarter panel 20. The first adhesive layer 40 is contactingly pressed against either a side wall (not shown) or an end wall (not shown) of the box thereby securing the foldable packaging device 10 within the box. By positioning and securing a plurality of foldable packaging devices 10 on the bottom of the box, placing the corners of the article within the packaging devices 10, and then positioning and securing a plurality of foldable packaging devices 10 about the upper corners of the foldable packaging device 10, the article is effectively "locked" into place within the box. Therefore, the size of the box is not dependent on the size of the article to be placed and secured therein.

The foldable packaging device 10 of the present invention overcomes the shortcomings of the prior art with novel, low cost open corner-shaped protection during storage and shipping. The foldable packaging device provides unique, self-contained protection for the corners and sides of articles when positioned within a box for storage and shipping.

Since the articles are "locked" within the box, regardless of the box size, and maintain their intended position within the box, the foldable packaging device 10 of the present invention reduces the necessary amount of required box inventory. Therefore, since boxes are less expensive when ordered in bulk, the foldable packaging device 10 of the present invention reduces the costs of maintaining a variety of box sizes for a variety of different sized articles.

Finally, the foldable packaging device 10 of the present invention has the capability of being shipped and stored in a substantially flat position. Shipping and storing the foldable packaging device 10 is the flat position saves valuable space during shipping and storage. Furthermore, the costs of storage and shipping of the foldable packaging device 10 in the flat position are also reduced due to the space savings.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein, may be suitably practiced in the absence of the specific elements which are disclosed herein.

I claim:

1. A cushioning device for protecting a corner and adjacent edges of an article when packaged in a container, the container having a plurality of sidewall container panels and a pair of end wall container panels, the intersection of a pair of sidewall container panels and one of the end wall container panels forming a container corner, the device comprising:

a panel member having a plurality of panel portions, each of the panel portions hingedly connected to at least one adjacent panel portion;

resilient foam cushioning means secured to at least one of the panel portions for cushioning the article wherein the panel portions fold into a three-dimensional receptacle forming an open corner cushioning device for protecting a corner and adjacent sides of the article; and securing means on the panel member for securing the panel member within the container wherein the open corner cushioning device is securable to one of the end wall container panels distant from each of the sidewall container panels and each of the container corners.

2. The cushioning device of claim 1 wherein the panel portions include a first panel portion, a second panel portion, a third panel portion, and a fourth panel portion, the first panel being foldably connected to the second panel portion and the fourth panel portion, the second panel portion being foldably connected to the third panel portion, and further comprising a slit formed between the third panel portion and the fourth panel portion.

3. The cushioning device of claim 2 wherein the resilient foam cushioning means comprises a first resilient foam cushioning pad secured to the first panel portion, a second resilient foam cushioning pad secured to the second panel portion, and a third resilient foam cushioning pad secured to the third panel portion, the fourth panel portion being free from a cushioning pad.

4. The cushioning device of claim 3 wherein the receptacle has an interior article receiving area, the resilient foam cushioning means covering substantially entirely the interior article receiving area.

5. The cushioning device of claim 1 wherein the panel portions of the panel member are substantially equal sized.

6. The cushioning device of claim 1 wherein the panel member is constructed from corrugated cardboard.

7. The cushioning device of claim 1 wherein the securing means is an adhesive layer.

8. The cushioning device of claim 7 and further comprising a liner cover releasably covering the adhesive layer, the liner cover removable to expose the adhesive layer.

9. The cushioning device of claim 1 and further comprising means for maintaining the panel member in a three-dimensional receptacle.

10. The cushioning device of claim 9 wherein the means for maintaining includes an adhesive layer.

11. A method for protecting a corner and adjacent edges of an article when packaged in a container, the container having a plurality of sidewall container panels and a pair of end wall container panels, the intersection of a pair of sidewall container panels and one of the end wall container panels forming a container corner, the method comprising:

providing a panel member having a plurality of panel portions;

hingedly connecting each of the panel portions to at least one adjacent panel portion;

securing resilient foam cushioning means to the panel member for cushioning the article;

folding the panel portions into a three-dimensional receptacle thereby forming an open corner cushioning device for protecting the corner and adjacent sides of the article; and securing the cushioning device to one of the end wall container panels distant from each of the sidewall container panels and each of the container corners.

12. The method of claim 11 and further comprising the panel portions including a first panel portion, a second panel portion, a third panel portion, and a fourth panel portion, and further still comprising foldably connecting the first panel to the second panel portion and the fourth panel portion, and foldably connecting the second panel portion to the third panel portion, and further yet comprising forming a slit between the third panel portion and the fourth panel portion.

13. The method of claim 12 wherein the resilient foam cushioning means are a plurality of foam cushioning pads, and further comprising securing a first resilient foam cushioning pad to a first panel portion, securing a second resilient foam cushioning pad to a second panel portion, and securing a third resilient foam cushioning pad to a third panel portion.

14. The method of claim 13 and further comprising covering substantially entirely an interior article receiving area of the receptacle with the foam cushioning pads.

15. The method of claim 13 and further comprising the panel member is constructed from corrugated cardboard.

16. The method of claim 11 wherein the cushioning device is secured within the box with an adhesive layer.

17. The method of claim 16 and further comprising releasably covering the adhesive layer with a liner cover, and further yet comprising removing the liner cover to expose the adhesive layer.

18. The method of claim 11 and further comprising means for maintaining the panel member in a three-dimensional receptacle.

* * * * *